US007795810B2

(12) United States Patent
Boy et al.

(10) Patent No.: US 7,795,810 B2
(45) Date of Patent: Sep. 14, 2010

(54) GAS-FILLED DISCHARGE GAP

(75) Inventors: Juergen Boy, Berlin (DE); Wolfgang Daeumer, Berlin (DE); Frank Werner, Berlin (DE)

(73) Assignee: Epcos AG, Munich (DE)

( * ) Notice: Subject to any disclaimer, the term of this patent is extended or adjusted under 35 U.S.C. 154(b) by 228 days.

(21) Appl. No.: 11/859,586

(22) Filed: Sep. 21, 2007

(65) Prior Publication Data

US 2008/0048545 A1 Feb. 28, 2008

Related U.S. Application Data

(63) Continuation of application No. PCT/DE2006/000347, filed on Feb. 24, 2006.

(60) Provisional application No. 60/974,320, filed on Sep. 21, 2007.

(30) Foreign Application Priority Data

Mar. 23, 2005 (DE) ..... 10 2005 013 499

(51) Int. Cl.
*H01J 17/00* (2006.01)
*H01J 63/04* (2006.01)

(52) U.S. Cl. ..... 313/581; 313/567

(58) Field of Classification Search ..... 313/484, 313/581–582, 567
See application file for complete search history.

(56) References Cited

U.S. PATENT DOCUMENTS

| | | | |
|---|---|---|---|
| 4,670,360 | A | 6/1987 | Habermann et al. |
| 5,671,114 | A | 9/1997 | Däumer et al. |
| 5,892,648 | A | 4/1999 | Bobert et al. |
| 5,995,355 | A | 11/1999 | Daeumer |
| 6,326,724 | B1 | 12/2001 | Däumer et al. |
| 6,529,361 | B1 | 3/2003 | Petschel et al. |
| 2006/0209485 | A1 | 9/2006 | Imai et al. |

FOREIGN PATENT DOCUMENTS

| | | | |
|---|---|---|---|
| DE | 3430485 | A1 | 2/1986 |
| DE | 197 01 816 | A1 | 7/1997 |
| DE | 198 14 631 | A1 | 9/1999 |
| EP | 1 612 899 | A1 | 1/2006 |
| JP | 2003-007420 | * | 1/2003 |
| WO | WO 2004/091060 | A1 | 10/2004 |

* cited by examiner

*Primary Examiner*—Joseph L Williams
*Assistant Examiner*—Brenitra M Lee
(74) *Attorney, Agent, or Firm*—Slater & Matsil, L.L.P.

(57) ABSTRACT

A gas-filled discharge gap includes at least two electrodes and an electrode-activation mass that is arranged on at least one of the electrodes. The electrode-activation mass contains $K_2WO_4$.

17 Claims, 1 Drawing Sheet

GAS-FILLED DISCHARGE GAP

This application is a continuation of co-pending International Application No. PCT/DE2006/00347, filed Feb. 24, 2006, which designated the United States and was not published in English, and which is based on German Application No. 10 2005 013 499.8 filed Mar. 23, 2005. This application also claims priority to U.S. Provisional Application No. 60/974,320, filed Sep. 21, 2007. Each of these applications is incorporated herein by reference.

TECHNICAL FIELD

The invention pertains to a gas-filled discharge gap such as a spark gap or an overvoltage arrestor.

BACKGROUND

A gas-filled discharge gap is known from German patent application DE 198 14 631 A1 and corresponding U.S. Pat. No. 6,326,724. In this case, a vitreous-type electrode-activation mass is used that comprises a plurality of components, including, among others, a base component in the form of cesium tungstate ($Cs_2WO_4$).

Another gas-filled discharge gap is known from German patent application DE 197 01 816 A1 and corresponding U.S. Pat. No. 5,995,355.

SUMMARY

Embodiments of the invention disclose a gas-filled discharge gap with adequate quenching properties.

DETAILED DESCRIPTION OF ILLUSTRATIVE EMBODIMENTS

Embodiments of the invention disclose a gas-filled discharge gap with at least two electrodes, wherein an electrode-activation mass containing potassium tungstate ($K_2WO_4$) is applied to at least one of the electrodes in order to ensure ignition properties. Potassium tungstate has the properties of a getter material. This material is chemically very stable and can also exert a gettering effect following a surge current. An additional property consists of the generation of free potassium and/or potassium oxide due to the reduction of the $K_2WO_4$ in the gas-filled cavity, resulting in a low work function of the activation mass.

Potassium tungstate melts at a soldering temperature of approximately 820°, whereby, specifically, loose activation particles are bound so as to prevent the escape of loose activation particles from the activation mass.

The inventive utilization of an activation mass containing potassium tungstate or one of the other potassium compounds ensures very good quenching properties of the overvoltage arrestor gap downstream of an electric load. An overvoltage arrestor with an activation mass containing $K_2WO_4$ automatically and reliably quenches after a discharge process despite an applied DC voltage.

Figure 1:
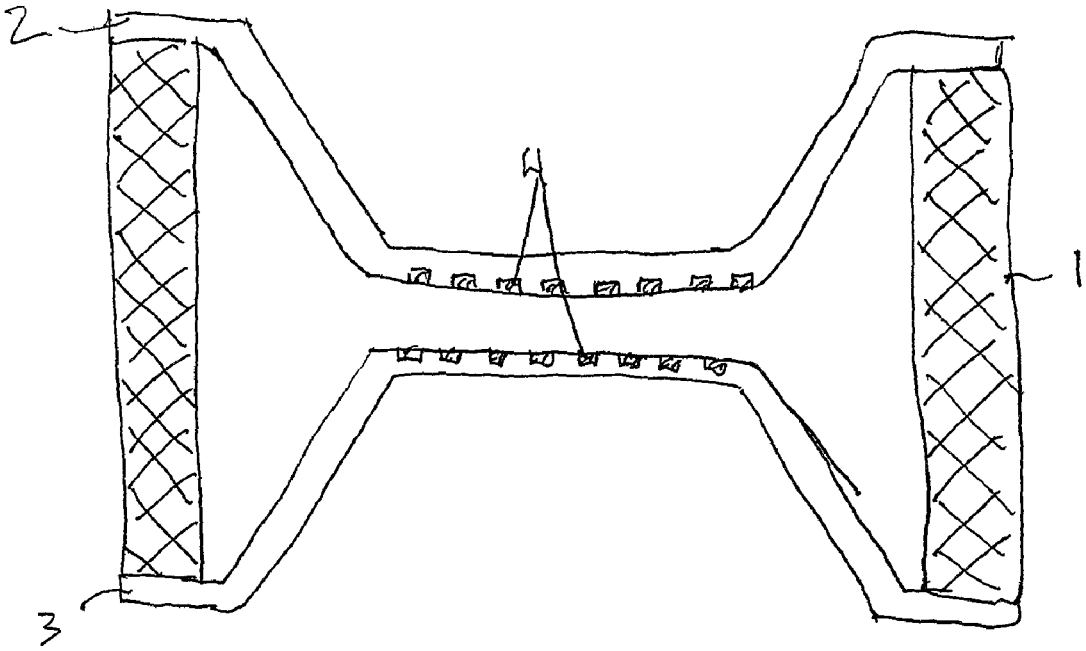
FIG. 1 illustrates a first preferred embodiment discharge gap in the form of a spark gap.

Reference is now made to FIG. 1. According to a first preferred embodiment, a discharge gap in the form of a spark gap is disclosed that features, for example, a ceramic hollow body 1 of preferably cylindrical shape with a surface area. The open end surfaces of the hollow body 1 are closed by end electrodes 2 and 3. This results in a closed cavity that is filled with a noble gas.

The activation mass 4 is arranged on the active surfaces of the opposing electrodes 2 and 3. The active surfaces may feature at least one or more depressions in the form of a waffle-like structure for accommodating the activation mass 4. The term "waffle-like structure" should be interpreted to mean in the form of intersecting depressions. Alternately, the active surface of an electrode may feature several depressions that do not intersect.

Figure 2:
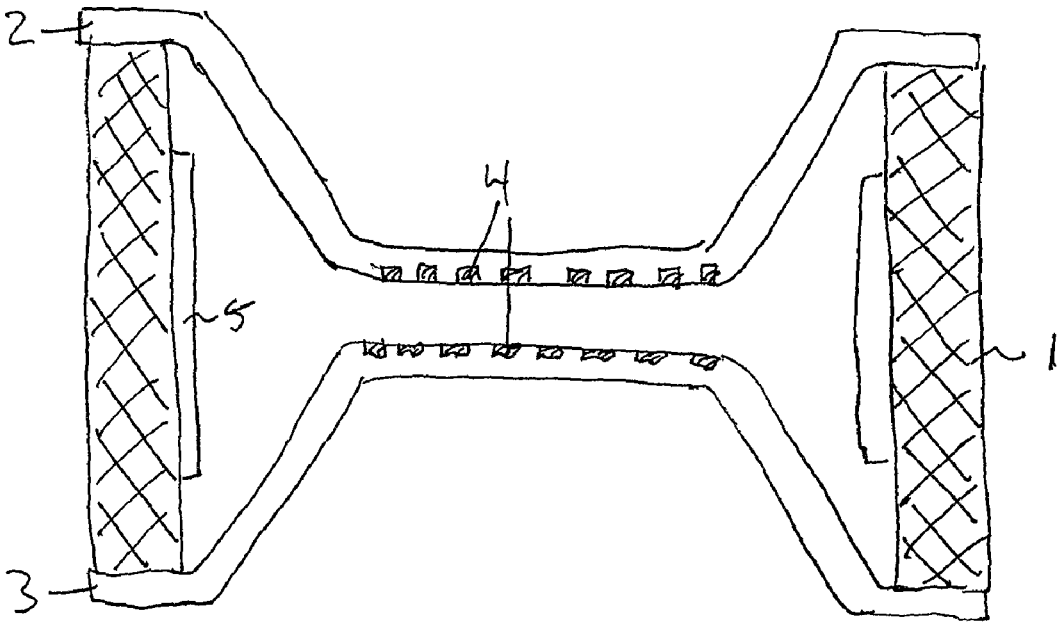
FIG. 2 illustrates a second preferred embodiment discharge gap in the form of a two-gap overvoltage arrestor.

Referring to FIG. 2, according to a second preferred embodiment, a discharge gap in the form of a two-gap overvoltage arrestor is disclosed that features two end electrodes 2 and 3 that are preferably arranged on the end surfaces of the hollow body 1, and a hollow-cylindrical center electrode 5. A hollow-cylindrical ceramic insulator preferably is respectively arranged between the center electrode 5 and one of the end electrodes 2 and 3.

The activation mass 4 is suitable for being applied to the center electrode 5 as well as on the end electrodes 2 and 3 of the overvoltage arrestor. The center electrode 5 may be provided with a peripheral groove not shown) for accommodating the activation mass 4.

In both embodiments, the activation mass 4 may be arranged on the end electrodes 2 and 3 on the opposing active electrode surfaces, i.e., in the depressions provided for this purpose.

The activation mass 4 may include a base component, e.g., $K_2WO_4$.

The activation mass 4 may contain several components, particularly base components. In one advantageous variant, $K_2WO_4$ is provided as one base component of the activation mass, e.g., in a quantity between approximately 20 and 90 wt %, preferably in a quantity between 30 and 60 wt %.

In one embodiment, the activation mass 4 may contain at least one base component and other additives. Here, one of the base components is $K_2WO_4$.

Other base components to be considered specifically include 1) metal oxides, e.g., $TiO_2$;
2) metallic components, e.g., Al and metallic Ti; and
3) halides, e.g., KBr and NaBr.

The activation mass may furthermore contain a glass fraction or silicates, e.g., sodium silicate, cesium silicate and potassium silicate. $BaTiO_3$, $TiO_2$, $LiNbO_3$, $Na_2B_4O_7$ and MgO may also be considered. $Na_2B_4O_7$ and MgO are particularly suitable as additives.

The base components may be respectively provided in a quantity of approximately 10 to 90 wt %, and the additives may be respectively provided in a quantity of less than approximately 10 wt %.

According to another embodiment, $K_2WO_4$ may be provided as an additive, e.g., in a quantity between 1 and 20 wt %, preferably in a quantity between 5 and 10 wt %.

What is claimed is:

1. A gas-filled discharge gap comprising:

at least two electrodes; and an electrode-activation mass arranged on at least one of the electrodes, wherein the electrode-activation mass comprises a base component of $K_2WO_4$, wherein the $K_2WO_4$ is provided in a quantity between approximately 20 and 90 wt %.

2. The discharge gap according to claim 1, wherein the discharge gap is realized in the form of a spark gap with two end electrodes arranged on end surfaces.

3. The discharge gap according to claim 1, wherein the discharge gap is realized in the form of an overvoltage arrestor with two end electrodes arranged on end surfaces.

4. The discharge gap according to claim 1, wherein the electrode-activation mass is arranged in a depression of at least one of the electrodes.

5. The discharge gap according to claim 1, wherein the at least two electrodes comprise a first electrode and a second electrode, the discharge gap further comprising a cylindrical-shaped hollow body, wherein open end surfaces of the hollow body are closed by the first electrode and the second electrode.

6. The discharge gap according to claim 5, wherein the hollow body and the first and second electrodes form a closed cavity that is filled with a noble gas.

7. The discharge gap according to claim 5, wherein the electrode-activation mass is arranged on active surfaces of the first and second electrodes.

8. The discharge gap according to claim 7, wherein the active surfaces include one or more depressions, the electrode-activation mass arranged in the one or more depressions.

9. The discharge gap according to claim 8, wherein each of the first and second electrodes comprises a waffle-like structure for accommodating the electrode-activation mass.

10. The discharge gap according to claim 8, wherein the active surface of each electrode comprises a plurality of depressions that do not intersect.

11. The discharge gap according to claim 1, wherein the at least two electrodes comprise a first end electrode, a second end electrode and a center electrode, the discharge gap further comprising a hollow-cylindrical ceramic insulator arranged between the center electrode and one of the end electrodes.

12. The discharge gap according to claim 1, wherein the $K_2WO_4$ is provided in a quantity between approximately 30 and 60 wt %.

13. A gas-filled discharge gap comprising:

a first end electrode;

a second end electrode;

a center electrode; and an electrode-activation mass arranged on the center electrode, wherein the electrode-activation mass contains $K_2WO_4$, wherein the $K_2WO_4$ is provided in a quantity between approximately 20 and 90 wt %.

14. The discharge gap according to claim 13, wherein the electrode-activation mass is further arranged on each of the first and second end electrodes.

15. The discharge gap according to claim 13, wherein the center electrode includes a peripheral groove for accommodating the electrode-activation mass.

16. The discharge gap according to claim 13, wherein the electrode-activation mass further contains a metal oxide, a metallic component, or a halide.

17. The discharge gap according to claim 13, further comprising a hollow-cylindrical ceramic insulator arranged between the center electrode and the first end electrode.

* * * * *